United States Patent [19]

Takimoto et al.

[11] 4,362,800

[45] Dec. 7, 1982

[54] SENSITIZED PHOTOCONDUCTIVE COMPOSITIONS AND ELECTROPHOTOGRAPHIC PHOTOSENSITIVE LAYERS USING SUCH

[75] Inventors: Masaaki Takimoto; Kenichi Sawada; Kouichi Kawamura, all of Asaka, Japan

[73] Assignee: Fuji Photo Film Co., Ltd., Kanagawa, Japan

[21] Appl. No.: 299,424

[22] Filed: Sep. 4, 1981

[30] Foreign Application Priority Data

Sep. 5, 1980 [JP] Japan ..... 55-123067

[51] Int. Cl.[3] ..... G03G 5/04

[52] U.S. Cl. ..... 430/83; 430/93; 430/95; 430/38; 313/385

[58] Field of Search ..... 430/83, 92, 93, 95

[56] References Cited

U.S. PATENT DOCUMENTS 4,040,825 8/1977 Steiger et al. ..... 430/93 X

*Primary Examiner*—John D. Welsh

*Attorney, Agent, or Firm*—Sughrue, Mion, Zinn, Macpeak & Seas

[57] ABSTRACT

A photoconductive composition for electrophotography containing a photoconductive material, a sensitizing dye comprising a specific very stable sensitizing dye for red light to infrared rays, and a film-forming polymer binder.

8 Claims, No Drawings

SENSITIZED PHOTOCONDUCTIVE COMPOSITIONS AND ELECTROPHOTOGRAPHIC PHOTOSENSITIVE LAYERS USING SUCH

FIELD OF THE INVENTION

This invention relates to a photoconductive composition comprising a photoconductive material dispersed in a binder comprising a film-forming resin and an electrophotographic photosensitive layer using the photoconductive composition, said photoconductive material being spectrally sensitized by a dye. More particularly the invention relates to a photoconductive composition spectrally sensitized to red light to infra-red rays and an electrophotographic photosensitive layer using the composition.

BACKGROUND OF THE INVENTION

Many spectral sensitizing dyes are known in the field of electrophotographic photosensitive layers for a photoconductive material-resin dispersion system. These spectral sensitizing dyes must have various properties and among them, it is particularly important for the dyes to be adsorbed well on the photoconductive materials, for the dyes to have high sensitizing efficiency, and for the dyes to not excessively reduce the dark resistance of electrophotographic photosensitive materials. Examples of the dyes satisfying these conditions are described in U.S. Pat. Nos. 3,052,540, 3,110,591, 3,125,447, 3,128,179, 3,132,942, 3,241,959 and 3,121,008 and British Pat. No. 1,093,823.

Spectral sensitizing dyes for red light to infrared rays are described in U.S. Pat. Nos. 3,619,154 and 3,682,630 but these dyes have severe practical faults because they tend to decompose and hence they are greatly decomposed during storage of the dyes or during production or storage of the electrophotographic photosensitive layers containing the dyes, thereby the properties of the photosensitive layers are deteriorated. Harazaki et at. in *Kogyo Kagaku Zasshi,* Vol. 66, No. 2, 26 (1963) state that sensitizing dyes for red light to infrared rays are unstable in comparison with sensitizing dyes for light (visible light) having shorter wavelengths than above.

SUMMARY OF THE INVENTION

An object of this invention is to provide a photoconductor-resin dispersion type photoconductive composition containing a spectral sensitizing dye for red light to infrared rays having excellent storage stability and an electrophotographic photosensitive layer using the photoconductive composition.

Accordingly, this invention provides (1) in one embodiment, a photoconductive composition containing a photoconductor, a sensitizing dye, and a film-forming polymer binder, wherein the sensitizing dye is a compound shown by the following general formula (I) or (II):

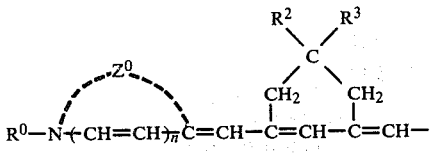

(I)

-continued

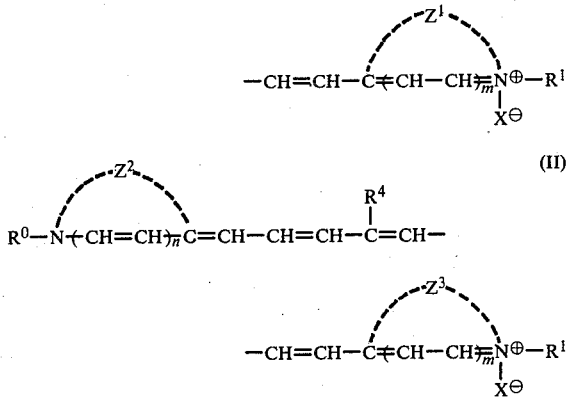

(II)

wherein $R^0$ and $R^1$, which may be the same or different, each represents an alkyl group, a hydroxyalkyl group, an alkoxyalkyl group, an aralkyl group, a carboxyalkyl group, a carboxylatoalkyl group linked to an alkali metal cation, a sulfoalkyl group or a sulfonatoalkyl group linked to an alkali metal cation; $R^2$ and $R^3$ each represents a hydrogen atom, or an alkyl group having 1 to 5 carbon atoms such as a methyl group or an ethyl group; $R^4$ represents a hydrogen atom, a halogen atom, a hydroxy group, a carboxy group, an alkyl group having 1 to 5 carbon atoms, an unsubstituted or substituted aryl group, or an acyloxy group shown by

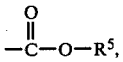

wherein $R^5$ represents an alkyl group having 1 to 5 carbon atoms, a phenyl group, or a substituted phenyl group; $Z^0$ and $Z^1$ each represents an atomic group necessary for forming a 5-membered or 6-membered heterocyclic ring or a condensed ring including a 5-membered or 6-membered heterocyclic ring; $Z^2$ and $Z^3$ each represents an atomic group necessary for forming a 3,3-dialkylindole ring or a 3,3-dialkylbenzo[e]indole ring; m and n each represents 0 or 1; and $X^{\ominus}$ represents an acid anion, and (2) in another embodiment of this invention, an electrophotographic photosensitive layer comprising the photoconductive composition (1).

DETAILED DESCRIPTION OF THE INVENTION $R^0$ and $R^1$ in the above-described general formula (I) or (II) each represents an alkyl group having 1 to 12 carbon atoms, a hydroxyalkyl group having 1 to 6 carbon atoms, an alkoxyalkyl group wherein the alkoxy moiety has 1 to 6 carbon atoms and the alkyl moiety has 1 to 6 carbon atoms, an aralkyl group having 7 to 12 carbon atoms, a carboxyalkyl group wherein the alkyl moiety has 1 to 6 carbon atoms, a carboxylatoalkyl group linked to an alkali metal cation, wherein the alkyl moiety has 1 to 6 carbon atoms, a sulfoalkyl group having 1 to 6 carbon atoms, a sulfonatoalkyl group linked to an alkali metal cation, wherein the alkyl moiety has 1 to 6 carbon atoms.

Examples of suitable alkyl groups shown by $R^0$ and $R^1$ include a methyl group, an ethyl group, a propyl group, a butyl group, an isopropyl group, an isobutyl group, a pentyl group, and an isoamyl group; examples of hydroxyalkyl groups shown by $R^0$ and $R^1$ are a 2-hydroxyethyl group, a 3-hydroxybutyl group, etc.; examples of alkoxyalkyl groups are a 2-methoxymethyl group and a 2-methoxyethyl group; examples of carboxyalkyl groups are a carboxymethyl group, a 2-carboxyethyl group, a 1-carboxyethyl group, a 3-carboxypropyl group, and a 4-carboxybutyl group; examples of carboxylatoalkyl groups linked to an alkali metal cation are a sodium carboxylatomethyl group, a lithium carboxylatomethyl group, a potassium carboxylatomethyl group, a sodium 2-carboxylatoethyl group, a lithium 2-carboxylatoethyl group, a potassium 2-carboxylatoethyl group, a sodium 1-carboxylatoethyl group, a sodium 3-carboxylatopropyl group, and a sodium 4-carboxylatobutyl group; examples of sulfoalkyl groups are a sulfomethyl group, a 2-sulfoethyl group, a 3-sulfopropyl group and a 4-sulfobutyl group; examples of sulfonatoalkyl groups linked to an alkali metal cation are a sodium sulfonatomethyl group, a potassium sulfonatomethyl group, a lithium sulfonatomethyl group, a sodium 2-sulfonatoethyl group, a potassium 2-sulfonatoethyl group, a lithium 2-sulfonatoethyl group, a sodium 3-sulfonatopropyl group, and a sodium 4-sulfonatobutyl group; and examples of aralkyl groups are a benzyl group, a phenethyl group and a naphthylmethyl group.

$X^{\ominus}$ in the above-described general formulae represents an acid anion and examples of such an acid anion are chlorine anion, bromine anion, iodine anion, thiocyanate, methyl sulfate, ethyl sulfate, benzene sulfonate, p-toluenesulfonate, perchlorate anion, and acetate.

In general formula (I), $Z^0$ and $Z^1$ each represents an atomic group necessary for forming a 5-membered or 6-membered heterocyclic ring or a condensed ring including a 5-membered or 6-membered heterocyclic ring, the heterocyclic ring containing at least one heteroatom selected from the group consisting of S, N, O and Se in the ring. Examples of 5-membered heterocyclic rings and condensed rings including 5-membered heterocyclic ring are rings such as thiazole rings (e.g., thiazole, 4-methylthiazole, 5-methylthiazole, 4-phenylthiazole, 5-pehnylthiazole, 4,5-dimethylthiazole, 4,5-diphenylthiazole, 4-(2-thienyl)thiazole, etc.), benzothiazole rings (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, 4,5,6,7-tetrahydrobenzothiazole, 5,6-dimethoxybenzothiazole, 5-hydroxybenzothiazole, 6-hydroxybenzothiazole, 5,6-methylenedioxybenzothiazole, etc.), naphthothiazole rings (e.g., α-naphthothiazole, β-naphthothiazole, 5-methoxy-β-naphthothiazole, 5-ethoxy-β-naphthothiazole, 7-methoxy-α-naphthothiazole, 8-methoxy-α-naphthothiazole, etc.), thieno[2,3-e]benzothiazole rings (e.g., 5-methoxythieno[2,3-e]benzothiazole, etc.), oxazole rings (e.g., 4-methyloxazole, 5-methyloxazole, 4-ethyloxazole, 5-ethyloxazole, 4,5-dimethyloxazole, 4,5-diethyloxazole, 4-phenyloxazole, 5-phenyloxazole, 4,5-diphenyloxazole, etc.), benzoxazole rings (e.g., benzoxazole, 5-methylbenzoxazole, 6-methylbenzoxazole, 5-ethylbenzoxazole, 5,6-dimethylbenzoxazole, 4,6-dimethylbenzoxazole, 5-phenylbenzoxazole, 5-methoxybenzoxazole, 6-methoxybenzoxazole, 5-ethoxybenzoxazole, 5-hydroxybenzoxazole, 6-hydroxybenzoxazole, 5-chlorobenzoxazole, 6-chlorobenzoxazole, 5-carboxybenzoxazole, etc.), naphthoxazole rings (e.g., naphtho[2,1-d]oxazole, naphtho[1,2-d]oxazole, naphtho[2,3-d]oxazole, etc.), selenazole rings (e.g., 4-methylselenazole, 4-phenylselenazole, etc.), benzoselenazole rings (e.g., benzoselenazole, 5-chlorobenzoselenazole, 5-methoxybenzoselenazole, 5-hydroxybenzoselenazole, 4,5,6,7-tetrahydrobenzoselenazole, etc.), naphthoselenazole rings (e.g., naphtho[2,1-d]selenazole, naphtho[1,2-d]selenazole, etc.), thiazoline rings (e.g., thiazoline, 4-methylthiazoline, etc.), 3,3-dialkylindole rings (e.g., 3,3-dimethylindole, 3,3,5-trimethylindole, 3,3,7-trimethylindole, etc.), and 3,3-dialkylbenzo[e]indole rings (e.g., 3,3-dialkylbenzo[e]indole, etc.). Also, examples of 6-membered heterocyclic rings and condensed rings including 6-membered heterocyclic rings are quinoline rings (e.g., quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, etc.), isoquinoline rings (e.g., isoquinoline, 3,4-dihydroisoquinoline, etc.), and pyridine rings (e.g., pyridine, 2-methylpyridine, 3-methylpyridine, 4-methylpyridine, 2,3-dimethylpyridine, 2,4-dimethylpyridine, 2,5-dimethylpyridine, 2,6-dimethylpyridine, 3,4-dimethylpyridine, 3,5-dimethylpyridine, 2-chloropyridine, 3-chloropyridine, 4-chloropyridine, 2-hydroxypyridine, 3-hydroxypyridine, 4-hydroxypyridine, 2-phenylpyridine, 3-phenylpyridine, 4-phenylpyridine, etc.).

$R^4$ in general formula (II) represents a hydrogen atom, a halogen atom, a hydroxy group, a carboxy group, an alkyl group having 1 to 5 carbon atoms, an unsubstituted or substituted aryl group, wherein the substituent includes at least one alkyl group having 1 to 5 carbon atoms, a halogen atom and an alkoxy group having 1 to 5 carbon atoms, or an acyloxy group shown by $$-\underset{\underset{O}{\|}}{C}-O-R^5.$$

For $R^4$, examples of halogen atoms are a fluorine atom, a chlorine atom, a bromine atom, an iodine atom, etc.), examples of alkyl groups having 1 to 5 carbon atoms are a methyl group, an ethyl group, a propyl group, a butyl group, a pentyl group, an isopropyl group, an isobutyl group, and an isoamyl group; examples of unsubstituted aryl groups are a phenyl group, a naphthyl group, an indenyl group, etc.; and examples of substituted aryl groups are a tolyl group, an ethylphenyl group, a xylyl group, a mesityl group, a cumenyl group, a methylnaphthyl group, an ethylnaphthyl group, a chlorophenyl group, a bromophenyl group, a chloronaphthyl group, a methoxyphenyl group, and an ethoxyphenyl group.

$R^5$ of the above-described acyloxy group represents an alkyl group having 1 to 5 carbon atoms, a phenyl group, or a substituted phenyl group, the substituent including an alkyl group having 1 to 5 carbon atoms, a halogen atom and an alkoxy group having 1 to 5 carbon atoms. Examples of alkyl groups having 1 to 5 carbon atoms are a methyl group, an ethyl group, a propyl group, a butyl group, a pentyl group, an isopropyl group, an isobutyl group, an isoamyl group, etc., and examples of substituted phenyl groups are a tolyl group, an ethylphenyl group, a chlorophenyl group, a bromophenyl group, a methoxyphenyl group, an ethoxyphenyl group, etc.

$Z^2$ and $Z^3$ in general formula (II) represent an atomic group necessary for forming a 3,3-dialkylindole ring or a 3,3-dialkylbenzo[e]indole ring, wherein the alkyl moiety has 1 to 6 carbon atoms. Examples of 3,3-dialkylindole rings are a 3,3-dimethylindole ring, a 3,3,7-trimethylindole ring, etc., and examples of 3,3-dialkylbenzo[e]indole rings are a 3,3-dimethylbenzo[e]-indole ring, etc.

Among the dye compounds which can be used in this invention, there are compounds wherein a carboxy group or a sulfo group is linked to the nitrogen atom of the heterocyclic ring shown by $Z^0$, $Z^1$, $Z^2$ or $Z^3$ through an alkyl group and these compounds include an anhydronium base shown by general formula (I) or (II) from which $X^{\ominus}$ is removed (i.e., the carboxy group or the sulfo group is changed to a carboxylato group $—COO^{\ominus}$ or a sulfonato group $—SO_3^{\ominus}$). Such anhydronium base type dye compounds are dye compounds well known to those skilled in the art in the field of sensitizing dyes.

In this invention the problem that an electrophotographic photosensitive layer containing a conventional sensitizing dye for red light to infrared rays cannot be stored for a long time can be overcome by using the sensitizing dye having the above-described specific skeleton structure. That is, the invention shows remarkable advantages in that the decomposition of sensitizing dyes during the production of the photosensitive layers as well as even under severe conditions of 50° C. and 80% RH (relative humidity), the sensitizing dyes used in this invention show very excellent stability as compared with conventional sensitizing dyes for red light to infrared rays.

The sensitizing dyes used in this invention may be used as ordinary sensitizing dyes for visible light. Also since concerns on specific conditions for mixing and dispersing the dyes and the need for cautiously selecting the point of adding the dyes are eliminated, the process of producing the photosensitive materials is simplified and photographic materials having stable quality and properties are obtained.

Also, an inorganic photoconductor such as usually a powder of zinc oxide, titanium oxide, zinc sulfide, cadmium sulfide, etc., is used as a photoconductor and when sensitizing dyes exist together with such a photoconductor, conventional sensitizing dyes tend to decompose under irradiation of light. When conventional sensitizing dyes for red light to infrared rays are used, the formation of photosensitive layers must be performed in the dark, etc. However, according to this invention, such restrictions are greatly decreased.

The sensitizing dyes in this invention may be used in any conventional manner. For example, a solution of the dye can be added to a dispersion of a photoconductor in a binder resin, or a photoconductor can be added to a solution of the dye to adsorb the dye onto the photoconductor and then the photoconductor is dispersed in a binder resin is a particularly convenient technique. The amount of the sensitizing dye used in this invention can vary widely depending on the extent of sensitization required. That is, the sensitizing dye can be used in a range of about 0.0005 to about 2.0 parts by weight, preferably 0.001 to 1.0 part by weight per 100 parts by weight of photoconductor used.

The sensitizing dyes used in this invention can be incorporated in a photosensitive layer individually or as a combination of two or more dyes. The sensitizing dyes used in this invention spectrally sensitize to the light range of red light to infrared rays. These dyes can also be used together with conventionally known spectrally sensitizing dyes for visible light, as desired. Furthermore, in using zinc oxide, as a photoconductor, an acid anhydride, etc., is sometimes added to promote the spectral sensitization and in this invention various known additives for electrophotographic photosensitive layers can be used also since the sensitizing dyes of this invention have sufficiently high stability.

Any binders conventionally known can be utilized in this invention. Typical examples of suitable binders are vinyl chloride-vinyl acetate copolymer, styrene-butadiene copolymer, styrene-butyl methacrylate copolymer, polymethacrylate, polyacrylate, polyvinyl acetate, polyvinyl butyral, alkyd resin, silicone resin, epoxy resin, epoxy ester resin, polyester resin, etc. Also, these polymers may be used in combination with aqueous acrylic emulsions or aqueous acrylester emulsions. The binder can be used in a range of about 1 to 200 parts, preferably 3 to 50 parts by weight per 100 parts by weight of photoconductor.

In general, sensitizing dyes are easily oxidized and hence it is preferred to avoid the use of a catalytic compound, etc., which promotes oxidation. For example, among vinyl polymerization initiators, the use of peroxides such as benzoyl peroxide or organic acid salts of a heavy metal promoting the hardening of unsaturated fatty acids must be avoided. In this point, even in the case of using the sensitizing dyes of this invention, the situation is almost same as the case of using conventional sensitizing dyes but it should be noticed that in the case of conventional sensitizing dyes for red light to infrared rays, conventional dyes decompose in a short period of time even when they are not used together with these oxidation accelerators.

The electrophotographic photosensitive layer of this invention can be formed on a conventional support. Generally speaking, it is preferred for the support for electrophotographic photosensitive layer to be electrically conductive and hence metal plates, synthetic resin films having an electrically conductive layer formed thereon (e.g., with a thin layer of aluminum, palladium, tin oxide, indium oxide, cuprous iodide, etc.), papers rendered electrically conductive can be easily used. Materials for treatment of papers to render them electrically conductive include known polymers containing a quaternary ammonium salt (e.g., polyvinylbenzyltrimethyl ammonium chloride); polymers containing a quaternary nitrogen in the main chain as described in U.S. Pat. Nos. 4,108,802, 4,118,231, 4,126,467 and 4,137,217; and quaternary salt polymer latexes as described in U.S. Pat. Nos. 4,070,189 and 4,147,550; and *Research Disclosure*, #16258; sulfonates of polystyrene; and colloidal alumina and these materials are usually used together with polyvinyl alcohol, styrene butadiene latex, gelatin, casein, etc.

The compound shown by general formula (I) or (II) can be prepared in the following manner:

The compound shown by general formula (I) can be prepared by condensing a compound shown by general formula (III):

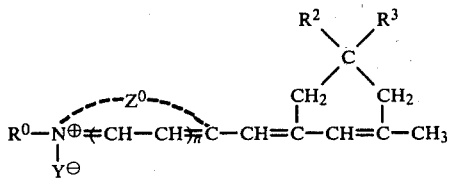

(III)

wherein $R^0$, $R^2$, $R^3$, $Z^0$ and n have the same significance as in general formula (I) and $Y^\ominus$ represents an acid anion as described for $X^\ominus$, and a compound shown by general formula (IV):

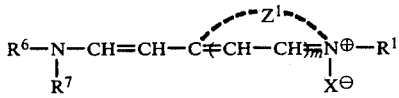

(IV)

wherein $R^1$, $Z^1$, $X^\ominus$ and m have the same significance as in general formula (I); $R^6$ represents a phenyl group or a substituted phenyl group such as a tolyl group, a xylyl group, a chlorophenyl group, etc.; and $R^7$ represents an acyl group such as an acetyl group, a propionyl group, a benzoyl group, etc. The reaction ratio of the compounds of formula (III) and (IV) is about 0.5 to 1.5 moles, most preferably 1 mole of the compound shown by general formula (IV) per 1 mole of the compound shown by general formula (III).

The compound shown by general formula (II) can be prepared by condensing the compound shown by general formula (V):

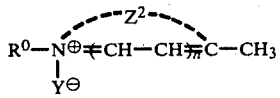

(V)

wherein $R^0$, $R^2$ and n have the same significance as in general formula (II) and $Y^\ominus$ represents an acid anion as described for $X^\ominus$, the compound shown by general formula (VI):

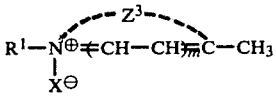

(VI)

wherein $R^1$, $Z^3$, $X^\ominus$ and m have the same significance as in general formula (II), and a compound shown by general formula (VII)

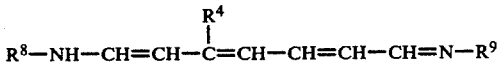

(VII)

wherein $R^4$ has the same significance as in general formula (II); and $R^8$ and $R^9$ each represents a phenyl group or a substituted phenyl group such as a tolyl group, a xylyl group, a chlorophenyl group, etc.

In addition, when the compound of formula (V) is different from the compound of formula (VI), it is necessary to first condense one of these compounds of formula (V) or (VI) with the compound of formula (VII) and then the condensation product is condensed with the other compound of the formula (V) or (VI). For example, the compound of formula (V) can be first condensed with the compound of formula (VII) and then the condensation product obtained is condensed with the compound of formula (VI). The reaction ratio of the compounds of formulae (V), (VI) and (VII) is about 0.5 to 1.5 moles, most preferably 1 mole, of the compound of formula (V) or formula (VI) per 1 mole of the compound of formula (VII), in a case that the compound of formula (V) is the same as the compound of formula (VI), and about 0.5 to 1.5 moles, most preferably 1 mole, of the condensation product of the compound of formula (VII) with one of the compounds of formula (V) or (VI) per 1 mole of the other compound of formula (VI) or (V) in a case that the compound of formula (V) is different from the compound of formula (VI).

The condensation reaction of the compound of formula (III) and the compound of formula (IV) or the condensation reaction of the compound of formula (V), the compound of formula (VI), and the compound of formula (VII) is accelerated by heating the condensation reaction system. The optimum heating temperature depends upon the reactants but is generally the boiling points of the reactants. It is particularly preferred to perform the reaction in a solvent inert to the reaction, such as pyridine, quinoline, 1,4-dioxane, etc.

Furthermore, in the condensation reaction of the compound of formula (III) and the compound of formula (IV), a lower alkyl alcohol such as ethanol, propanol, isopropyl alcohol, butanol, isobutyl alcohol, etc., may be used as the solvent. The condensation reaction of the compound of formula (V), the compound of formula (VI), and the compound of formula (VII) can be performed in an acid anhydride. Examples of acid anhydrides which can be used for the reaction are acid anhydrides of fatty acids such as acetic anhydride, propionic anhydride, etc., and anhydrides of aromatic carboxylic acids, such as benzoic anhydride, etc.

It is preferred to perform the condensation reaction of the compound of formula (III) and the compound of formula (IV) or the condensation reaction of the compound of formula (V), the compound of formula (VI), and the compound of formula (VII) in the presence of a basic condensing agent. Examples of condensing agents which can be used are trialkylamines such as triethylamine, tripropylamine, etc.; N-alkylpiperidines such as N-methylpiperidine, N-ethylpiperidine, etc.; and N,N-dialkylanilines such as N,N-dimethylaniline, etc. Also, in place of these amines, basic inorganic salts such as sodium acetate, potassium acetate, etc., may be used. The starting materials of the compounds (V), (VI) and (VII) are produced according to the procedures described in F. M. Hamer, *The Cyanine Dyes and Related Compounds,* Vol. 18, John Wiley & Sons Co. (1964).

The compound of formula (I) and the compound of formula (II) can be also prepared using other methods than the above-described methods. Suitable methods are also described in T. H. James, Ed., *The Theory of the Photographic Process,* 4th Edition, Macmillan Co., New York (1977) and F. M. Hamer, *The Cyanine Dyes and Related Compounds,* John Wiley & Sons Co., New York (1964).

Examples of production of compounds shown by general formula (I) are illustrated by reference to production of Dye Compound (1) and Dye Compound (3) shown below and an example of the production of the compound shown by general formula (II) is illustrated by reference to production of Dye Compound (2) shown below.

The compound names of dyes used in this specification are in accordance with the nomenclature employed in F. M. Hamer, *The Cyanine Dyes and Related Compounds,* supra, and U.S. Pat. No. 2,734,900.

Preparation of Dye Compound (1): 3-Ethyl-3′-β-carboxyethyl-9,11-neopentylenethiatricarbocyanine iodide:

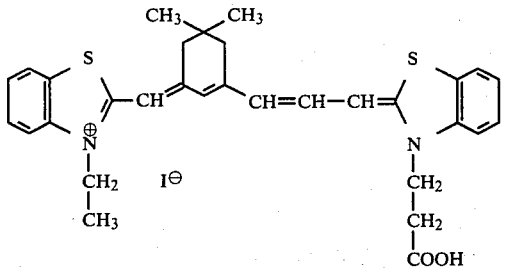

In 8 ml of pyridine were dissolved 0.85 g of 3-ethyl-2-(3,5,5-trimethyl-2-cyclohexen-1-ylidene)-methylbenzothiazolium iodide and 1.01 g of 2-[β-(N-phenylacetamido)vinyl]-3-β-carboxyethylbenzothiazolium iodide and, after adding thereto 0.5 ml of triethylamine, the mixture was refluxed for 5 minutes. After cooling the reaction mixture, 100 ml of diethyl ether was added and crystals thus precipitated were recovered by filtration.

The crystals were dissolved in 20 ml of ethanol and 0.3 ml of an aqueous 57% hydrogen iodide solution was added to precipitate crystals, which were recovered by filtration and recrystallized from ethanol. The amount of the product obtained was 1.52 g and the melting point was 166°–167° C.

Preparation of Dye Compound (2): 1,1-Di(δ-sodium sulfonatobutyl)-3,3,3′,3′-tetramethyl-4,5,4′,5′-dibenzoindotricarbocyanine iodide:

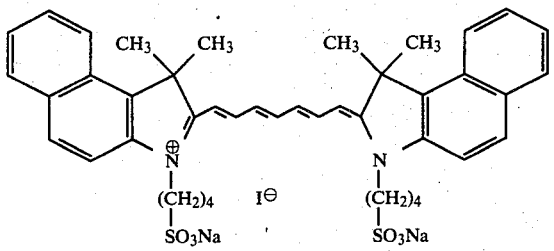

A mixture of 0.50 g of 1-(δ-sodium sulfonatobutyl)-2,3,3-trimethylbenzo[e]indolenium iodide, 0.25 g of 1-phenylamino-5-phenylimino-1,3-pentadiene, and 0.40 ml of aniline was heated to 70° C. for 10 minutes. After ice-cooling the mixture, 10 ml of diethyl ether was added and after stirring the mixture for 1 to 2 minutes, the supernatant was removed.

To the residue were added 0.5 g of 1-(δ-sodium sulfonatobutyl)-2,3,3-trimethylbenzo[e]indolenium iodide, 0.40 g of potassium acetate, and 0.38 ml of acetic anhydride and then the mixture was heated again to 70° C. for 10 minutes. After cooling the reaction mixture, diethyl ether was added to form crystals, which were recovered by filtration and recrystallized from ethanol to provide 0.55 g of crystals. The melting point was 220°–221° C.

Preparation of Dye Compound (3): 1,1′-Di(δ-sodium sulfonatobutyl)-3,3,3′,3′-tetramethyl-9,11-neopentylene-4,5,4′,5′-dibenzindotricarbocyanine iodide

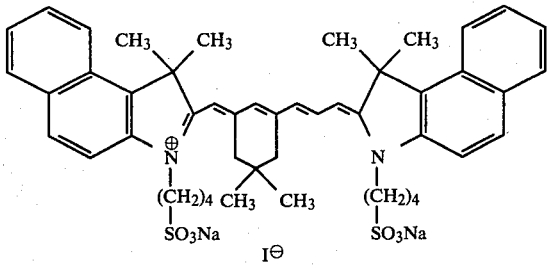

In 15 ml of ethanol were dissolved 0.61 g of 1-(δ-sodium sulfonatobutyl)-3,3-dimethyl-2-[(3,5,5-trimethyl-2-cyclohexen-1-ylidene)methyl]benzo[e]indolenium iodide and 0.64 g of 1-(δ-sodium sulfonatobutyl)-3,3-dimethyl-2-[β-(N-phenylacetamido)vinyl]-benzo[e]indolenium iodide and to the mixture 0.25 ml of triethylamine was dissolved. The mixture was refluxed for 15 minutes. After cooling the reaction mixture, 50 ml of diethyl ether was added to form crystals, which were recovered by filtration and recrystallized from ethanol to provide 0.73 g of crystals having a melting point of 205°–206° C.

The photoconductive composition of this invention can be used as the photosensitive layer (photoconductive layer) for a single layer type electrophotographic photosensitive material as well as the charge carrier generating layer for electrophotographic photosensitive materials having a charge carrier generating layer and a charge carrier transporting layer and further can be used as photoconductive particles in photoelectrophoresis type electrophotography or as the photosensitive composition incorporated in the photosensitive particles.

The photoconductive composition of this invention can be also used as a photoconductive layer of a video camera tube for receptive red light or infrared rays as well as a photoconductive layer sensitive to red light or infrared rays for a solid image pick-up element having a light-receiving layer (photoconductive layer) formed over the entire surface of a semiconductor circuit arranged one-dimensionally or two-dimensionally for performing transmission or scanning of signals.

The invention is further explained in greater detail by reference to the following examples. Unless otherwise indicated herein, all parts, percents, ratios and the like are by weight.

EXAMPLE 1

Comparison Dye Compound:

-continued

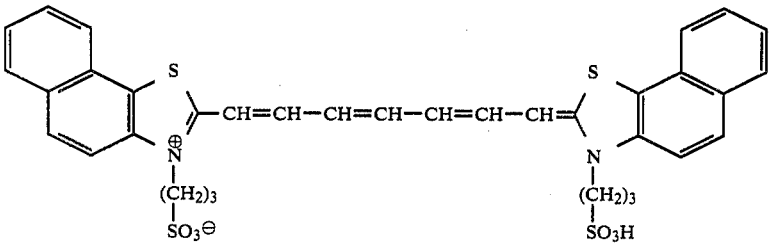

Dye Compound (1):

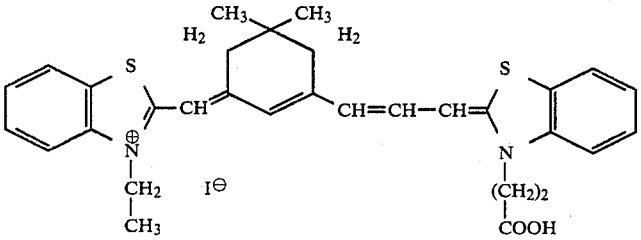

Dye Compound (2):

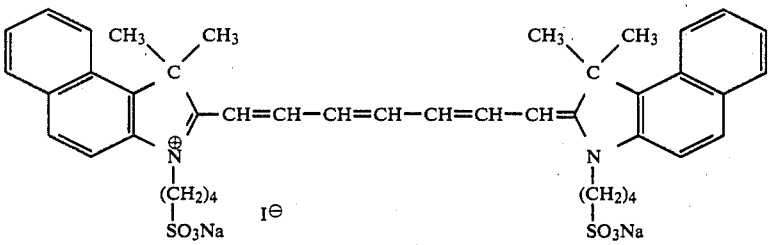

Each of the three dye compounds shown above was dissolved in methanol to provide $1.0\times10^{-3}$ mole/l of a dye solution. The solutions showed the absorption maximum at a wavelength of 799 nm for the Comparison Dye Compound, a wavelength of 769 nm for Dye Compound (1), and a wavelength of 787 nm for Dye Compound (2).

After mixing 100 parts of fine particulate zinc oxide (mean particle size of 0.5–1 μm, Sazex 2000, registered trade mark, made by Sakai Kagaku K.K.), 30 parts of a toluene solution of 40% by weight acrylic resin (Dianarl LR 009, registered trade mark, made by Mitsubishi Rayon Co., Ltd.), 60 parts of toluene and 8 parts of a methanol-solution of each of the above-described dye compound, the mixture was kneaded for 2 hours in a porcelain ball mill. Thus, three kinds of dispersions were prepared. Each of the dispersions was coated on an aluminum foil at a dry thickness of about 8 μm and then dried for 2 hours in a chamber kept at 50° C. to form an electrophotographic photosensitive layer. The spectral reflectance of each of the electrophotographic photosensitive layers thus formed was measured and also the spectrogram was taken with an ordinary electrophotographic process using a liquid developer containing carbon black as a toner.

The spectral reflectances confirmed that the electrophotographic photosensitive layer containing Dye Compound (1) or (2) showed a clear absorption maximum at a wavelength of 784 nm or 808 nm, respectively but the electrophotographic photosensitive layer containing the Comparison Dye Compound showed no absorption near a wavelength of 800 nm.

The spectrogramic measurements confirmed that the electrophotographic photosensitive layer containing Dye Compound (1) or (2) showed a sensitivity due to spectral sensitization in the wavelength region corresponding to the above-described spectral reflectance in addition to the response for the specific light-sensitive region of ZnO near a wavelength of 380 nm. On the other hand, the electrophotographic photosensitive layer containing the Comparison Dye Compound showed no response other than the response for the specific light-sensitive region of ZnO. In other words, it was clear that the electrophotographic photosensitive layer containing the Comparison Dye Compound had not been spectrally sensitized.

EXAMPLE 2

Using the three dye compounds shown in Example 1, electrophotographic photosensitive layers were prepared in a different manner than that used in Example 1.

After mixing 100 parts of fine particulate zinc oxide (mean particle size of 0.5–1 μm, Sazex 2000, registered trade mark, made by Sakai Kagaku K.K.), 35 parts of a toluene solution of 25% by weight styrenated alkyd resin (Styresol #4250, registered trade mark, made by Nippon Reichhold Co.), and 40 parts of toluene, the mixture was kneaded for 2 hours in a porcelain ball mill to form a white dispersion. To the dispersion was added 15 parts of a butyl acetate solution of 25% by weight polyisocyanate resin (Barnock D-750, registered trade mark, made by Nippon Reichhold Co.) while stirring the dispersion well and the dispersion was divided into three parts. To each dispersion was added 10 parts of an ethanol solution containing each of the three kinds of dye compounds shown in Example 1 and the mixture was stirred well. Each of the dispersions was coated on an aluminum foil in a dry thickness of 10 μm, and dried for 15 hours in a chamber kept at 50° C. Thus, three kinds of electrophotographic photosensitive materials were obtained. The electrophotographic photosensitive materials having the photosensitive layers containing the Comparison Dye Compound, Dye Compound (1), and Dye Compound (2) were called the Comparison Sample, Sample No. 1, and Sample No. 2, respectively.

The spectral reflectance and the spectral sensitivity in an electrophotographic process for these samples were measured. The absorbance in the absorption maximum wavelength in the wavelength region 700–850 nm of the spectral reflectance of the sample directly after the production thereof or after storage of the sample for one week under the accelerated conditions of 50° C. and 80% RH was measured and the ratio of the absorbance after storage divided by the absorbance directly after production was employed as a measure of stability. The stability increases as the ratio approaches to 1. The stability ratios are shown in Table 1 below. In addition, in the Comparison Sample, the reflectance maximums were observed at two portions of a wavelength of about 800 nm (corresponding to the absorption maximum wavelength of the Comparison Dye Compound) and the wavelength of about 380 nm (corresponding to the absorption maximum wavelength of ZnO) directly after the production thereof but the reflectance maximum at the wavelength of about 800 nm vanished with a flat spectral absorption curve and the reflectance maximum only at a wavelength of about 380 nm was observed after storage of the sample for one week under the accelerated conditions of 50° C. and 80% RH. This fact shows that the Comparison Dye Compound in the electrophotographic photosensitive layer vanished under the acceleration storage test condition.

TABLE 1

| | Comparison Sample | Sample No. 1 | Sample No. 2 |
|---|---|---|---|
| Stability Ratio | 0.0 | 0.9 | 1.0 |

Furthermore, the spectral sensitivities of Sample Nos. 1 and 2 directly after the preparation thereof and after storage were measured in a manner almost the same as that in Example 1, thereby the spectral sensitivity ratio almost the same as the aforesaid stability ratio was obtained. That is, Sample Nos. 1 and 2 exhibited almost the same desired spectral sensitivity using Dye Compounds (1) and (2) respectively directly after the production thereof and after storage.

EXAMPLE 3

The same procedure as in Example 1 or 2 was followed using a paper or a synthetic resin film as the support for the electrophotographic layer and almost the same results as in Example 1 or 2 were obtained. The paper support used was prepared by impregnating a wood free paper with a composition composed of polyvinyl alcohol and polyvinylbenzyltrimethylammonium chloride (6:4 by weight ratio) at 5 g/m$^2$. The surface electric resistivity of the paper was $5\times10^8\Omega$ at 25° C. and 50% RH. Also, a conductive transparent film prepared by vapor depositing indium oxide on the surface of a polyethylene terephthalate film of 100 μm thick was used as the synthetic resin film support. The surface electric resistivity of the film was $4\times10^4\Omega$.

While the invention has been described in detail and with reference to specific embodiments thereof, it will be apparent to one skilled in the art that various changes and modifications can be made therein without departing from the spirit and scope thereof.

What is claimed is:

1. An electrophotoconductive composition comprising:

(a) a photoconductor;

(b) a sensitizing dye represented by the following general formula (I) or (II):

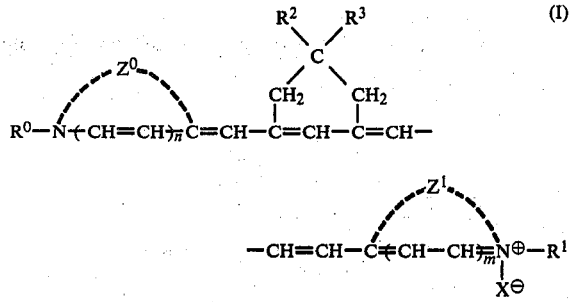

(I)

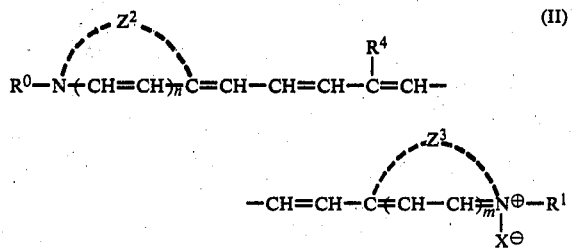

(II)

wherein $R^0$ and $R^1$, which may be the same or different, each represents an alkyl group, a hydroxyalkyl group, an alkoxyalkyl group, an aralkyl group, a carboxyalkyl group, a carboxylatoalkyl group linked to an alkali metal cation, a sulfoalkyl group, or a sulfonatoalkyl group linked to an alkali metal cation; $R^2$ and $R^3$ each represents a hydrogen atom, or an alkyl group having 1 to 5 carbon atoms; $R^4$ represents a hydrogen atom, a halogen atom, a hydroxy group, a carboxy group, an alkyl group having 1 to 5 carbon atoms, an unsubstituted or substituted aryl group, or an acyloxy group shown by

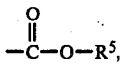

wherein $R^5$ represents an alkyl group having 1 to 5 carbon atoms, a phenyl group, or a substituted phenyl group; $Z^0$ and $Z^1$ each represents an atomic group necessary for forming a 5-membered or 6-membered heterocyclic ring or a condensed ring including a 5-membered or 6-membered heterocyclic ring; $Z^2$ and $Z^3$ each represents an atomic group necessary for forming a 3,3-dialkylindole ring or a 3,3-dialkylbenz[e]indole ring; m and n each represents 0 or 1; and $X^\ominus$ represents an acid anion; and (c) a film-forming high molecular weight binder.

2. The electrophotoconductive composition as claimed in claim 1, wherein the composition contains 0.0005 to 2.0 parts by weight of sensitizing dye (b) per 100 parts by weight of photoconductor (a).

3. The electrophotoconductive composition as claimed in claim 1, wherein the composition contains 0.001 to 1.0 parts by weight of sensitizing dye (b) per 100 parts by weight of photoconductor (a).

4. The electrophotoconductive composition as claimed in claim 1, wherein the photoconductor (a) is an inorganic photoconductor.

5. An electrophotographic photosensitive layer comprising a layer of a photoconductive composition containing:

(a) a photoconductor;

(b) a sensitizing dye represented by general formula (I) or (II):

(I)

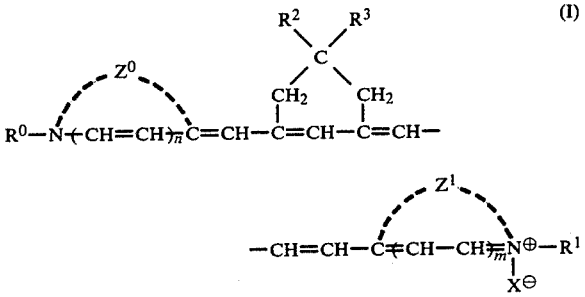

(II)

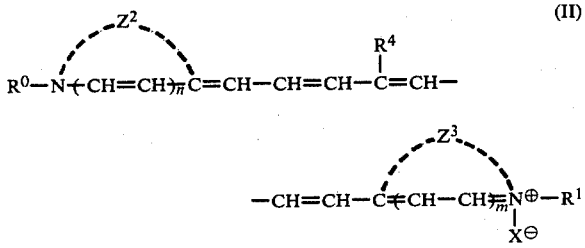

wherein $R^0$ and $R^1$, which may be the same or different, each represents an alkyl group, a hydroxyalkyl group, an alkoxyalkyl group, an aralkyl group, a carboxyalkyl group, a carboxylatoalkyl group linked to an alkali metal cation, a sulfoalkyl group, or a sulfonatoalkyl group linked to an alkali metal cation; $R^2$ and $R^3$ each represents a hydrogen atom, or an alkyl group having 1 to 5 carbon atoms; $R^4$ represents a hydrogen atom, a halogen atom, a hydroxy group, a carboxy group, an alkyl group having 1 to 5 carbon atoms, a substituted or unsubstituted aryl group, or an acyloxy group shown by $$-\overset{O}{\overset{\|}{C}}-O-R^5,$$

wherein $R^5$ represents an alkyl group having 1 to 5 carbon atoms, a phenyl group, or a substituted phenyl group; $Z^0$ and $Z^1$ each represents a 5-membered or 6-membered heterocyclic ring or an atomic group necessary for forming a condensed ring including a 5-membered or 6-membered heterocyclic ring; $Z^2$ and $Z^3$ each represents a 3,3-dialkylindole ring or an atomic group necessary for forming a 3,3-dialkylbenzo[e]indole ring; m and n each is 0 or 1; and $X^{\ominus}$ represents an acid anion; and (c) a film-forming high molecular weight binder.

6. The electrophotoconductive photosensitive layer as claimed in claim 5, wherein the composition contains about 0.0005 to about 2.0 parts by weight of sensitizing dye (b) per 100 parts of the photoconductor (a).

7. The electrophotoconductive photosensitive layer as claimed in claim 5, wherein the composition contains 0.001 to 1.0 parts by weight of sensitizing dye (b) per 100 parts by weight of the photoconductor (a).

8. The electrophotoconductive photosensitive layer as claimed in claim 5, wherein the photoconductor (a) is a powder of zinc oxide, titanium oxide, zinc sulfide, or cadmium sulfide.

* * * * *